US011864700B2

(12) United States Patent
Zhang

(10) Patent No.: US 11,864,700 B2
(45) Date of Patent: Jan. 9, 2024

(54) SELF-CLEANING METHOD FOR CLEANING ROBOT, CLEANING ROBOT, AND CLEANING SYSTEM

(71) Applicant: SHENZHEN FLY RODENT DYNAMICS INTELLIGENT TECHNOLOGY CO., LTD., Shenzhen (CN)

(72) Inventor: Hao Zhang, Shenzhen (CN)

(73) Assignee: Shenzhen Fly Rodent Dynamics Intelligent Technology Co., Ltd., Guangdong (CN)

( * ) Notice: Subject to any disclaimer, the term of this patent is extended or adjusted under 35 U.S.C. 154(b) by 233 days.

(21) Appl. No.: 17/183,546

(22) Filed: Feb. 24, 2021

(65) Prior Publication Data

US 2022/0095869 A1 Mar. 31, 2022

(30) Foreign Application Priority Data

Sep. 30, 2020 (CN) ..... 202011066381.5

(51) Int. Cl.

*A47L 11/40* (2006.01)
*A47L 9/04* (2006.01)
*A47L 11/14* (2006.01)

(52) U.S. Cl.

CPC ..... *A47L 11/4011* (2013.01); *A47L 9/0477* (2013.01); *A47L 11/145* (2013.01); *A47L 2201/028* (2013.01); *A47L 2201/06* (2013.01)

(58) Field of Classification Search

CPC .. A47L 11/4011; A47L 9/0477; A47L 11/145; A47L 2201/028; A47L 2201/06; A47L 11/28; A47L 11/4091; A47L 11/302; A47L 2201/022

See application file for complete search history.

(56) References Cited

U.S. PATENT DOCUMENTS

2018/0344112 A1 12/2018 Krebs et al.

FOREIGN PATENT DOCUMENTS

| | | | | |
|---|---|---|---|---|
| CN | 102121900 A | | 7/2011 | |
| CN | 102727135 A | | 10/2012 | |
| CN | 105476545 A | | 4/2016 | |
| CN | 106618392 A | * | 5/2017 | ..... A47L 11/4094 |
| CN | 109528093 A | | 3/2019 | |

(Continued)

OTHER PUBLICATIONS

First Office Action for Chinese Patent Application No. 202011066381.5 issued by the Chinese Patent Office.

(Continued)

*Primary Examiner* — David Redding

(74) *Attorney, Agent, or Firm* — IP & T GROUP LLP

(57) ABSTRACT

A cleaning robot includes a cleaning device for cleaning and a driving device for travelling. The cleaning robot is provided with an operating mode and a self-cleaning mode. The self-cleaning method includes: controlling the cleaning robot to enter the self-cleaning mode; controlling the cleaning device to operate and the driving device to stop operating after entering the self-cleaning mode. In the embodiments of the present disclosure, efficient, integrated, and comprehensive cleaning tasks can be implemented by a cleaning robot by controlling the cleaning robot to enter a self-cleaning mode and complete a self-cleaning operation under a particular condition.

18 Claims, 4 Drawing Sheets

(56) References Cited

FOREIGN PATENT DOCUMENTS

| | | | | | |
|---|---|---|---|---|---|
| CN | 109875464 | A | | 6/2019 | |
| CN | 109953700 | A | | 7/2019 | |
| CN | 110192806 | A | | 9/2019 | |
| CN | 110710931 | A | | 1/2020 | |
| CN | 10946524 | A | | 4/2020 | |
| CN | 210493961 | U | | 5/2020 | |
| CN | 111246204 | A | | 6/2020 | |
| CN | 210788264 | U | | 6/2020 | |
| CN | 111358342 | A | | 7/2020 | |
| CN | 111368393 | A | | 7/2020 | |
| CN | 112205930 | A | * | 1/2021 | ..... A47L 2201/00 |
| DE | 202016104066 | U1 | * | 10/2017 | ..... A47L 11/4088 |
| KR | 95-4473 | U | | 2/1995 | |

OTHER PUBLICATIONS

Second Office Action for Chinese Patent Application No. 202011066381.5 issued by the Chinese Patent Office.
First Search for Chinese Patent Application No. 202011066381.5 issued by the Chinese Patent Office.
Supplementary Search for Chinese Patent Application No. 202011066381.5 issued by the Chinese Patent Office.
Notification to Grant Patent Right for Invention for Chinese Patent Application No. 202011066381.5 issued by the Chinese Patent Office.

* cited by examiner

SELF-CLEANING METHOD FOR CLEANING ROBOT, CLEANING ROBOT, AND CLEANING SYSTEM

CROSS-REFERENCE TO RELATED APPLICATION

The present disclosure claims priority of Chinese patent application with the filing number 202011066381.5 filed on Sep. 30, 2020 with the Chinese Patent Office, and entitled "Self-cleaning Method for Cleaning Robot, Cleaning Robot, and Cleaning System", the contents of which are incorporated herein by reference in entirety.

TECHNICAL FIELD

The present disclosure relates to the technical field of cleaning robots, and in particular to a self-cleaning method for a cleaning robot, a cleaning robot, and a cleaning system.

BACKGROUND ART

A cleaning robot is a cleaning apparatus that washes hard floors and simultaneously sucks up dirty water and takes the dirty water away from the site. Cleaning robots have been very commonly used in various fields of society, especially in some places with broad hard floors, such as stations, docks, airports, workshops, warehouses, schools, hospitals, restaurants, and stores. The concept of cleaning with machinery instead of human labor has been deeply rooted among people. Recently, as this new cleaning style using cleaning robots has been accepted by people, there is a sharply increasing demand for cleaning robots.

Cleaning robots generally only have a floor cleaning function, but do not have a self-cleaning function. After such a cleaning robot has cleaned a floor, it is necessary to clean its mopping and wiping member to prepare for the next cleaning task. However, the mopping and wiping member should be cleaned manually, which is time-consuming and laborious. Consequently, the user experience is severely affected.

SUMMARY

One aspect of the present disclosure provides a self-cleaning method for a cleaning robot. The cleaning robot comprises a cleaning device configured for cleaning and a driving device configured for travelling, and the cleaning robot comprises an operating mode and a self-cleaning mode. The self-cleaning method comprises:

controlling the cleaning robot to enter the self-cleaning mode; and controlling the cleaning device to operate and the driving device to stop operating after entering the self-cleaning mode.

Another aspect of the present disclosure provides a cleaning robot. The cleaning robot comprises a cleaning device configured for cleaning, a driving device configured for travelling, and a control module, wherein the control module is electrically connected to the cleaning device and the driving device, respectively. The cleaning robot has an operating mode and a self-cleaning mode. The control module is configured to execute a self-cleaning method, and the self-cleaning method comprises:

controlling the cleaning robot to enter the self-cleaning mode; and controlling the cleaning device to operate and the driving device to stop operating after entering the self-cleaning mode.

In one aspect, the present disclosure provides a cleaning system. The cleaning system comprises a cleaning robot and a robot docking station, wherein the robot docking station comprises a charging stand and a tray connected to the charging stand, the tray is configured to carry the cleaning robot, the charging stand is configured to supply charging power to the cleaning robot. The cleaning robot comprises a cleaning device configured for cleaning, a driving device configured for travelling, and a control module, wherein the control module is electrically connected to the cleaning device and the driving device, respectively. The cleaning robot has an operating mode and a self-cleaning mode. The control module is configured to execute a self-cleaning method, and the self-cleaning method comprises:

controlling the cleaning robot to enter the self-cleaning mode; and controlling the cleaning device to operate and the driving device to stop operating after entering the self-cleaning mode.

BRIEF DESCRIPTION OF THE DRAWINGS

One or more embodiments are exemplarily described with reference to figures in the corresponding accompanying drawings. These exemplary descriptions are not intended to limit the embodiments. Elements/modules and steps marked with the same reference numerals in the drawings are represented as similar elements/modules and steps. The figures in the accompanying drawings do not constitute a scale limitation unless otherwise stated particularly.

DETAILED DESCRIPTION OF THE EMBODIMENTS

The present disclosure will be described in more detail below with reference to the accompanying drawings and specific embodiments, in order to facilitate the understanding of the present disclosure. It should be noted that, when an element is described to be "connected" to another element, it may be directly connected to the other element, or there may be one or more intervening elements therebetween. In addition, terms such as "first" and "second" are used for descriptive purposes only, and should not be understood as an indication or implication of relative importance.

Unless otherwise defined, all technical and scientific terms used herein have the same meanings as those commonly understood by those skilled in the technical field to which the present disclosure pertains. The terms used in the description of the present disclosure are intended for the purpose of describing specific embodiments only and are not intended to limit the present disclosure. As used herein, the term "and/or" includes any and all combinations of one or more of the associated listed items.

In addition, the technical features involved in different embodiments of the present disclosure described below can be combined with each other if they do not conflict with each other, and all such combinations shall fall within the scope of protection of the present disclosure. Although functional modules are divided in a schematic diagram of a device and a logical sequence is shown in a flowchart, in some cases, the modules in the device may be divided in a different way, or the shown or described steps may be performed in a different sequence from that shown in the flowchart.

Figure 1:
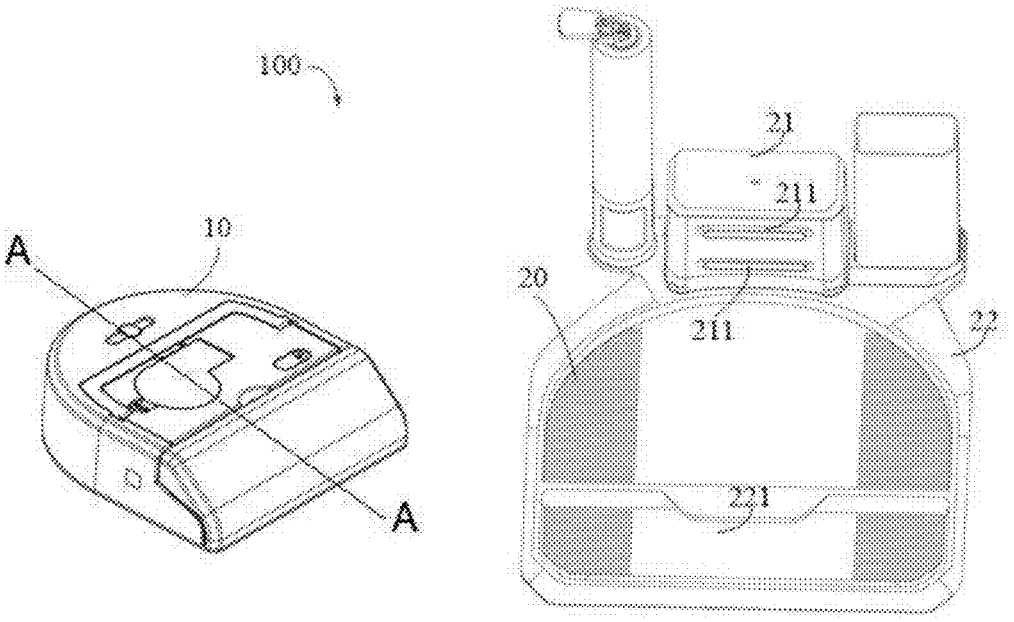
FIG. 1 is a schematic structural diagram of a cleaning system according to an embodiment of the present disclosure.

Referring to FIG. 1, FIG. 1 is a schematic structural diagram of a cleaning system according to an embodiment of the present disclosure. As shown in FIG. 1, the cleaning system 100 includes a cleaning robot 10 and a robot docking station 20. The robot docking station 20 includes a charging stand 21 and a tray 22 connected to the charging stand 21. The tray 22 can carry the cleaning robot 10. The charging stand 21 has a charging terminal 211. When the cleaning robot 10 moves onto the tray 22, the charging terminal 211 is connected to a charging interface on the cleaning robot 10 so that the charging stand 21 charges the cleaning robot 10.

In some embodiments, the tray 22 is provided with a cleaning groove 221. The cleaning robot 10 is equipped with a roller brush configured to rotate to scrub a floor. The cleaning groove 221 is configured to accommodate at least part of the roller brush to cooperate with an operation of cleaning for the roller brush, thereby enabling the self-cleaning of the cleaning robot 10.

In some embodiments, the tray 22 comprises a plurality of raised features arranged on the bottom of the cleaning groove 221. The plurality of raised features comprise a left part arranged on the left side of the bottom of the cleaning groove 221 and a right part arranged on the right side of the bottom of the cleaning groove 221. The left part and the right part present as a pattern respectively, for the purpose of non-slip while the wheels of the cleaning robot is traveling on the cleaning groove 221. Further, each raised feature is elongated convex structure.

Figure 2:
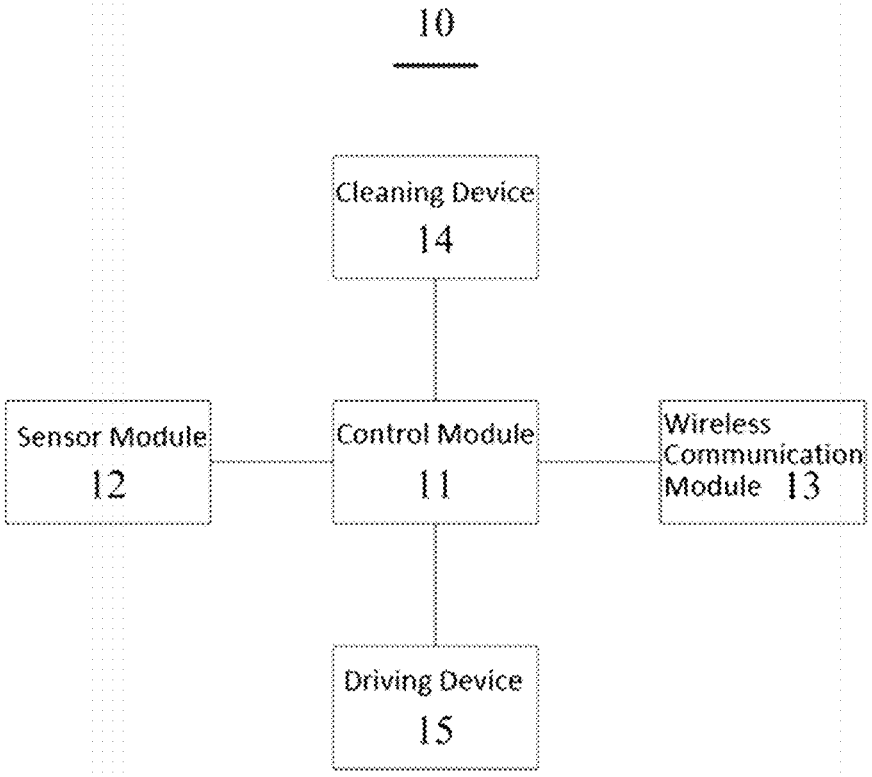
FIG. 2 is a structural block diagram of a cleaning robot according to an embodiment of the present disclosure.

Referring to FIG. 2, FIG. 2 is a structural block diagram of a cleaning robot according to an embodiment of the present disclosure. As shown in FIG. 2, the cleaning robot 10 includes a control module 11, a sensor module 12, a wireless communication module 13, a cleaning device 14, and a driving device 15.

Here, the cleaning robot 10 may be constructed in any suitable shape to implement specific services, functions, and operations. For example, in some embodiments, the cleaning robot 10 includes, but is not limited to, a floor sweeping robot, a vacuum cleaning robot, a floor mopping robot, a floor scrubbing robot, and the like.

As the control core of the cleaning robot 10, the control module 11 may use multiple path planning algorithms to control the cleaning robot 10 to carry out traversal operations. For example, the control module 11 uses a full-coverage path planning algorithm to instruct the cleaning robot 10 to completely traverse an environmental space. The full-coverage path planning algorithm refers to an algorithm allowing the cleaning robot 10 to plan a path after acquiring environmental information and establishing a map to achieve traversal of the environmental space.

The control module 11 may be a general-purpose processor, a digital signal processor (DSP), an application-specific integrated circuit (ASIC), a field programmable gate array (FPGA), a single-chip microcomputer, an ARM (Acorn RISC Machine) or another programmable logic device, discrete gate or transistor logic, or discrete hardware component, or any combination of these components. Additionally, the control module 11 may be any conventional processor, controller, microcontroller, or state machine. The control module 11 may also be implemented as a combination of computing devices, for example, a combination of a DSP and a microprocessor, multiple microprocessors, one or more microprocessors combined with a DSP, and/or any other such configuration.

The sensor module 12 is configured to collect some parameters of motion of the cleaning robot 10 and various data on the environmental space. The sensor module 12 includes various appropriate sensors, such as an inertial measurement unit (IMU), a gyroscope, a magnetometer, an accelerometer or speedometer, an optical camera, a lidar or acoustic radar, and the like.

In some embodiments, the control module 11 uses a SLAM technology for establishing a map and positioning according to environmental data. Based on the established map and the location of the cleaning robot 10, the control module 11 instructs the cleaning robot 10 to completely traverse an environmental space by using a full-coverage path planning algorithm. For example, before the cleaning robot 10 traverses, the sensor module 12 acquires an image of an area to be traversed, where the image of the area to be traversed may be an image of the entire area to be traversed, or an image of a partial area to be traversed in the entire area to be traversed. The control module 11 generates a map according to the image of the area to be traversed. The map has indicated the area to be traversed by the cleaning robot 10 and the coordinate positions of obstacles located in the area to be traversed. Each time the cleaning robot 10 has traversed a location or area, the cleaning robot makes a mark based on the map to indicate that the location or area has been traversed. Moreover, since an obstacle is marked in coordinates on the map, the cleaning robot 10 performing a traversal may judge its distance from the obstacle according to the coordinate point corresponding to the current location and the coordinate point related to the obstacle, thereby implementing a traversal around the obstacle. Similarly, when the cleaning robot 10 next moves to a location or area which has been traversed and thus marked, the cleaning robot 10 may make a strategy of making a turn or U-turn or stopping the traversal based on the map and based on the mark of the location or the area.

It will be understood that the control module 11 may identify a traversed location or area or identify an obstacle in multiple ways to make a control strategy that meets product requirements.

Figure 3:
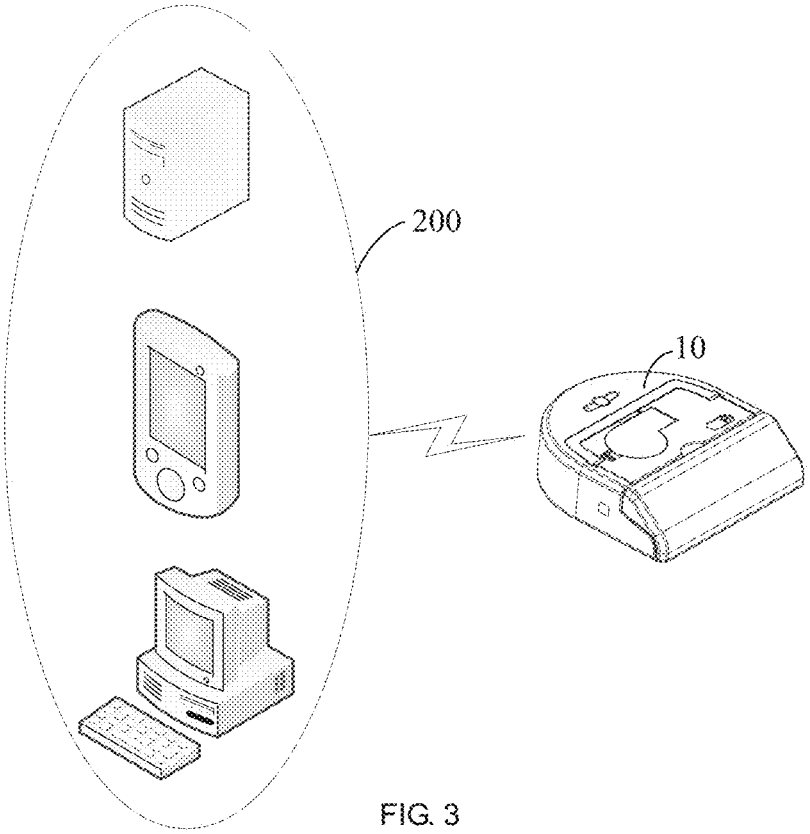
FIG. 3 is a schematic diagram of a communication architecture between a cleaning robot and an external terminal according to an embodiment of the present disclosure.

Referring to FIG. 3, FIG. 3 is a schematic diagram of a communication architecture between a cleaning robot and an external terminal according to an embodiment of the present disclosure. In some embodiments, as shown in FIG. 3, the cleaning robot 10 wirelessly communicates with an external terminal 200 through a wireless communication module 13. The wireless communication module 13 is electrically connected to the control module 11. During traversing, a user sends a control instruction to the cleaning robot 10 through the external terminal 200, the wireless communication module 13 receives the control instruction and sends the control instruction to the control module 11, and the control module 11 controls the cleaning robot 10 to complete the traversal operation according to the control instruction.

In some embodiments, the external terminal 200 includes terminals such as a smart phone, a remote controller, and a tablet computer.

In some embodiments, the wireless communication module 13 includes one or a combination of more of a broadcast receiving module, a mobile communication module, a wireless Internet module, a short-range communication module, and a positioning information module. Here, the broadcast receiving module receives a broadcast signal and/or broadcast-related information from an external broadcast management server via a broadcast channel. The broadcast receiving module may receive a digital broadcast signal using a digital broadcast system, such as Digital Multimedia Broadcasting-Terrestrial (DMB-T), Digital Multimedia Broadcasting-Satellite (DMB-S), Media Forward Link Only (MediaFLO), Digital Video Broadcasting-Handheld (DVB-H), or Integrated Services Digital Broadcasting-Terrestrial (ISDB-T).

The mobile communication module sends a wireless signal to at least one of a base station, an external terminal, and a server over a mobile communication network, or may receive a wireless signal from at least one of the base station, the external terminal, and the server. Here, the wireless signal may include a voice call signal, a video call signal, or data in various forms, according to reception and sending of characters/multimedia messages.

The wireless Internet module refers to a module configured for wireless Internet connection, which may be built-in or installed outside the terminal. It is possible to use wireless Internet technologies such as Wireless LAN (WLAN) (Wi-Fi), Wireless Broadband (Wibro), Worldwide Interoperability for Microwave Access (Wimax), and High-Speed Downlink Packet Access (HSDPA).

The short-range communication module refers to a module configured for short-range communication. It is possible to use short-distance communication technologies such as Bluetooth, Radio Frequency Identification (RFID), Infrared Data Association (IrDA), Ultra Wideband (UWB), or ZigBee.

Figure 4:
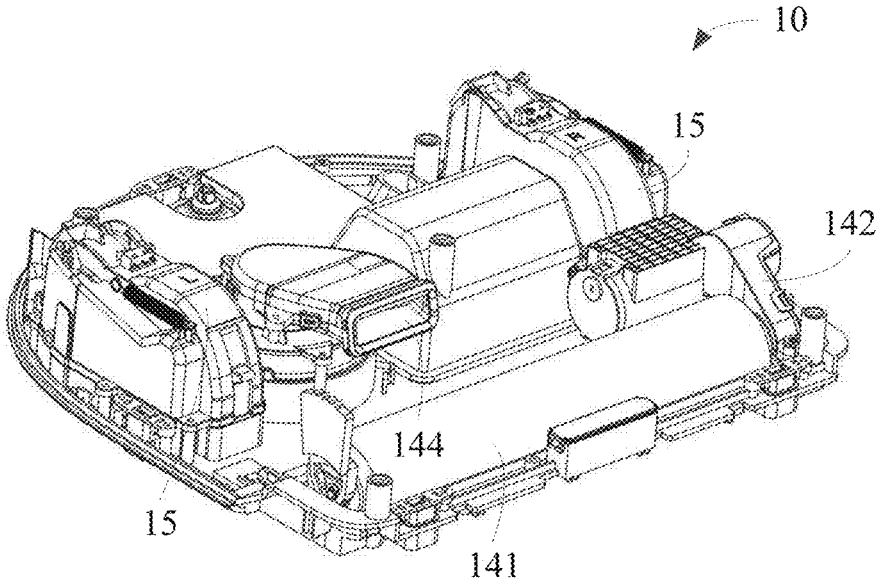
FIG. 4 is a partial schematic structural diagram of a cleaning robot according to an embodiment of the present disclosure.

The cleaning device 14 is configured to sweep or scrub a floor. The cleaning device 14 may be configured as any cleaning structure. For example, in some embodiments, as shown in FIG. 4, the cleaning device 14 includes a roller brush 141, a roller brush driving assembly 142, a liquid supply mechanism (not shown), a fan assembly 144, and a dirty water tank 145. The surface of the roller brush 141 is provided with a cleaning portion. The roller brush driving assembly 142 includes a drive mechanism and a cleaner motor. The roller brush 141 is connected to the cleaner motor by means of the drive mechanism. The cleaner motor is connected to the control module 11. The control module 11 may send an instruction to the cleaner motor and control the cleaner motor to drive a rotation of the roller brush 141 by means of the driving mechanism, so that its cleaning portion can effectively clean the floor. The liquid supply mechanism is connected to the control module 11. A liquid storage tank of the liquid supply mechanism is controlled by the control module 11 to deliver a cleaning fluid to the roller brush 141 through a liquid channel so as to supply the cleaning fluid to the roller brush 141. The roller brush 141 is soaked to improve the scrubbing effect. The cleaning liquid includes, but is not limited to, clean water, a cleaning agent, a cleaning fluid, and a combination thereof. The fan assembly 144 is connected to the control module 11. The fan assembly 144 includes a fan, an air extraction channel communicating with the fan, and an air discharge channel communicating with the fan. The dirty water tank 145 has a suction port 1452 and an air extraction port 1453. When the roller brush 141 is rotated, dirt brought up by the rotation of the brush 141 is sucked into the suction port 1452. The air extraction port 1453 communicates with the air extraction channel of the fan. The fan is operated to extract air under the control of the control module 11. When air is being extracted, a gas inside a tank body of the dirty water tank 145 is extracted through the air extraction port 1453 and discharged, whereby negative pressure is formed in the suction port 1452, so that dirt such as dirty water, debris, and hair is continuously and easily sucked into the tank body through the suction port 1452, and the sucked dirt is stored in a dirt storage space inside the tank body.

The driving device 15 is configured to drive the cleaning robot 10 to advance or retreat. During sweeping, the control module 11 sends a control instruction to the driving device 15, and the driving device 15 drives the cleaning device 14 to complete a cleaning operation according to the control instruction.

In some embodiments, the driving device 15 is divided into a left driving unit and a right driving unit. The left driving unit, taken as an example, includes a motor, a wheel driving mechanism, and a left wheel. The motor has a rotating shaft connected to the wheel driving mechanism. The left wheel is connected to the wheel driving mechanism. The motor is connected to the control module 11. The motor receives a control instruction sent from the control module 11 to rotate its rotating shaft, and the torque is transmitted to the left wheel through the wheel driving mechanism to enable the rotation of the left wheel. Meanwhile, the right driving unit cooperates with the left driving unit to drive the cleaning robot 10 to advance or retreat.

In some embodiments, the cleaning robot 10 is provided with an operating mode and a self-cleaning mode. Entry into the operating mode and into the self-cleaning mode may be controlled in various ways. For example, the whole machine may be controlled to enter the operating mode or the self-cleaning mode by an input module (e.g., a key, a display screen, or the like) arranged on the cleaning robot 10. Of course, the whole machine may also be controlled to enter the operating mode or the self-cleaning mode by the external terminal 200 (e.g., a remote controller, a mobile phone, or the like), or the whole machine may be automatically controlled to enter the operating mode or the self-cleaning mode when it is detected by, for example, a sensor, an internal detection circuit, or the like that a particular condition is met.

Here, in the operating mode, the cleaning device 14 and the driving device are controlled to operate simultaneously to implement a cleaning task in an area to be cleaned. In the self-cleaning mode, the cleaning device 14 is operated while the driving device 15 stops operating. At this time, the cleaning robot 10 stays in a designated area, such as a docking station 20 dedicated to self-cleaning tasks. In the designated area, the roller brush 141 of the cleaning device 14 is controlled to rotate, and the liquid supply mechanism is controlled to supply a liquid to the roller brush 141. At the same time, the fan assembly 144 is controlled to operate to remove dirt adhering to the roller brush 141. After it is determined that the dirt has been reliably removed from the roller brush 141, the roller brush 141 is controlled to stop rotating and the liquid supply mechanism is controlled to stop supplying the liquid to the roller brush 141. At this time, the fan assembly 144 is controlled to continue operating for a preset duration. In this process, the roller brush 141 is controlled to operate intermittently so as to dry the roller brush 141. After the roller brush 141 has been reliably dried, the fan assembly 144 is controlled to stop operating.

Figure 5:
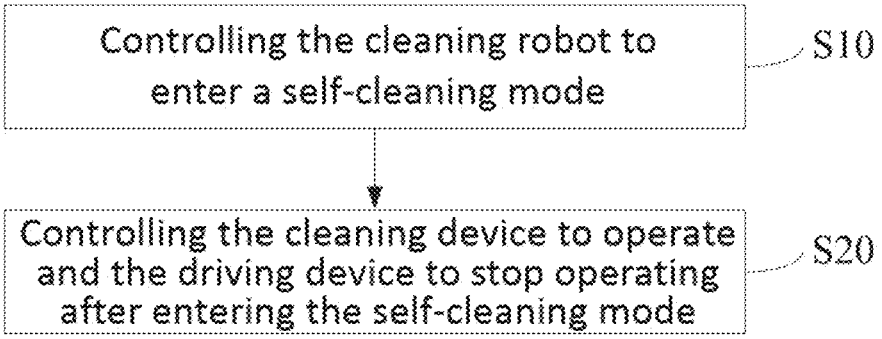
FIG. 5 is a schematic flowchart of a self-cleaning method for a cleaning robot according to an embodiment of the present disclosure.

Referring to FIG. 5, FIG. 5 is a schematic flowchart of a self-cleaning method for a cleaning robot according to an embodiment of the present disclosure. As shown in FIG. 5, the self-cleaning method includes follow steps.

In S10, the cleaning robot 10 is controlled to enter a self-cleaning mode.

The cleaning robot 10 includes a cleaning device 14 for cleaning and a driving device 15 for travelling. The cleaning robot 10 is provided with an operating mode and a self-cleaning mode. Here, the cleaning device 14 is a device for cleaning a floor by using a wetted roller brush. The roller brush may be wetted with a cleaning liquid applied by a liquid supply mechanism of the cleaning device or by a liquid supply mechanism of the cleaning robot, or may be wetted with a cleaning liquid on the floor or in the cleaning groove. The operating mode is a mode in which the cleaning robot 10 cleans the floor. In the operating mode, the cleaning robot 10 may perform cleaning tasks such as dirt removal and floor scrubbing in an area to be cleaned. The self-cleaning mode is a mode in which the cleaning robot cleans its components contaminated during cleaning tasks, such as a roller brush.

In S20, after entering the self-cleaning mode, the cleaning device 14 is controlled to operate and the driving device 15 is controlled to stop operating. Obviously, the self-cleaning of the cleaning robot is implemented in a simple and efficient manner and can be performed anytime and anywhere without additional assistance.

Here, the cleaning device 14 includes a roller brush 141, a roller brush driving mechanism 142, a liquid supply mechanism, and a fan assembly 144. The roller brush 141 is configured to rotate to scrub a floor. The roller brush driving mechanism 142 is connected to the roller brush 142 and configured to drive rotation of the roller brush 141. The liquid supply mechanism is configured to supply a cleaning liquid to the roller brush 141. The fan assembly 144 generates a suction force to suck dirt. Specifically, the cleaning device 14 further includes a dirty water tank 145 which has a suction port 1452 and an air extraction port 1453. The bottom of the dirty water tank 145 is provided with an accommodating groove 1451. At least part of the roller brush 141 is accommodated in the accommodating groove 1451. The suction port 1452 corresponds to the roller brush 141 and communicates with the accommodating groove 1451. The air extraction port 1453 communicates with the fan assembly 144. The liquid supply mechanism includes a liquid tank, a water pump communicating with the liquid tank, and a water outlet structure 1431 communicating with the water pump. The water outlet structure 1431 is arranged on a wall of the accommodating groove 1451 to supply a liquid to the roller brush 141.

The driving device 15 is configured to drive the cleaning robot 10 to advance or retreat, or to drive the cleaning robot 10 to move in any direction.

In the operating mode, the cleaning device 14 and the driving device 15 operate simultaneously to complete a cleaning task in a set area.

After the self-cleaning mode is activated, the cleaning device 14 is controlled to operate, and the driving device 15 is controlled to stop operating. In the self-cleaning mode, a self-cleaning operation is implemented by controlling the cleaning device 14 of the cleaning robot 10. Thus, efficient, integrated, and comprehensive cleaning tasks can be implemented. Moreover, the operation of the driving device 15 is stopped at this time. Therefore, the cleaning robot 10 can be parked and self-cleaned in a designated area dedicated to completion of the self-cleaning operation. This can avoid contamination of other cleaned areas during the self-cleaning operation and can improve the efficiency of self-cleaning.

When the cleaning robot 10 is to be controlled to enter the self-cleaning mode, the cleaning robot 10 is permitted to enter the self-cleaning mode only when a certain condition is met.

For example, in some embodiments, the cleaning robot 10 includes an input module which is connected to the control module 11. Then the step S10 includes:

receiving a self-cleaning instruction by the input module; and controlling the cleaning robot 10 to enter the self-cleaning mode according to the self-cleaning instruction.

Here, the input module is arranged on the cleaning robot 10, and the input module is connected to the control module 11 of the cleaning robot. The input module may include any device that can facilitate user interaction or user control, such as keys, a keyboard, buttons, a display screen, or the like. Of course, the input module may also include an interface device configured to enable contactless control. The interface device may receive a control instruction, such as a self-cleaning instruction, sent from an external apparatus. When the control module 11 receives a self-cleaning instruction through the interface device, the cleaning robot is controlled to enter the self-cleaning mode.

Of course, the controlling of the cleaning robot to enter the self-cleaning mode is not limited to being triggered by an external control, or may be triggered automatically. For example, in some embodiments, the step S10 includes:

acquiring an operating duration for which the cleaning robot 10 is operated in the operating mode; and judging whether the operating duration reaches a preset duration threshold;

if yes, controlling the cleaning robot 10 to enter the self-cleaning mode.

In this embodiment, when the cleaning robot 10 enters the operating mode, an operating duration for which the cleaning robot 10 is operated in the operating mode is first counted by a timer, and then it is judged whether the operating duration counted in real time reaches a preset duration threshold. The preset duration threshold may be programmed and set as actually required. When the operating duration counted in real time reaches the preset duration threshold, it can be considered that the cleaning robot 10 needs to perform a self-cleaning operation. Hence, the cleaning robot 10 is controlled to enter the self-cleaning mode. The preset duration threshold is determined depending on an electricity amount and a degree of dirtiness when the operating mode is activated, or the preset duration threshold is directly positively correlated with the electricity amount when the operating mode is activated. For example, when there is an electricity amount of 100% at the time of activation, which allows a continuous operation for 2 h in the operating mode, the preset duration threshold may be set to 1 h. When there is an electricity amount of 80% at the time of activation, which allows a continuous operation for 1.6 h in the operating mode, the preset duration threshold may be set to 0.8 h. When there is an electricity amount of 50% at the time of activation, which allows a continuous operation for 1 h in the operating mode, the preset duration threshold may be set to 0.5 h. In other words, the preset duration threshold is half of a duration of operation with the remaining electricity amount. The duration of operation with the remaining electricity amount may be the longest time in a maximum power-consuming operating state in the operating mode.

It will be understood that the user may decide whether to trigger the self-cleaning mode. For example, the self-cleaning mode may be set in the form of a key on the cleaning robot or a virtual key of an application on a smart phone. After the cleaning robot enters the operating mode, the steps of this embodiment may be performed when the user presses the key for the self-cleaning mode, and it is unnecessary to perform the steps of this embodiment when the user does not press the key for the self-cleaning mode. Therefore, user needs can be flexibly satisfied, and a better user experience is provided.

In order to better improve the self-cleaning effect of the cleaning robot 10, the cleaning robot 10 can be parked and self-cleaned in a designated area (e.g., the docking station 20) dedicated to completion of the self-cleaning operation. Hence, before the cleaning robot 10 is controlled to enter the self-cleaning mode, it is necessary, in some embodiments, to judge whether the cleaning robot 10 has moved to a predetermined position of the robot docking station 20. If the cleaning robot 10 has moved to the predetermined position of the robot docking station 20, the cleaning robot 10 is controlled to enter the self-cleaning mode. Here, when the cleaning robot 10 moves to the predetermined position of the robot docking station 20, the cleaning robot 10 is located on the tray 22 of the robot docking station 20, and the roller brush 141 of the cleaning robot 10 is just fitted in the cleaning groove 221 in the tray 22. For example, the cleaning groove 221 can accommodate at least a part of the roller brush 141 of the cleaning robot 10. During the self-cleaning process, the cleaning groove 221 can cooperate with the operation of cleaning the roller brush 141, whereby the roller brush 141 can be cleaned at improved efficiency with an improved effect. Obviously, a rack (or a toothed bar) may be arranged in the cleaning groove 221. The rack may be inserted into the roller brush 141 to scrape dirt off the surface of the roller brush 141.

It will be understood that when the cleaning robot is being self-cleaned on a floor, dirt cleaned from the roller brush 141 is sucked into the dirty water tank 145, and at the same time the roller brush 141 is also scrubbing the floor, thus the floor will not be contaminated.

When it is necessary to judge whether the cleaning robot 10 has moved to a predetermined position of the robot docking station 20, an environmental image may be acquired by the sensor module 12 of the cleaning robot 10, and then the position of the cleaning robot 10 relative to the robot docking station may be analyzed from the environmental image. When the environmental image indicates that the cleaning robot 10 has moved to the predetermined position of the robot docking station 20, the cleaning robot 10 is controlled to enter the self-cleaning mode.

In some embodiments, the judgment of whether the cleaning robot 10 has moved to the predetermined position of the robot docking station 20 may be performed in other ways. For example, when the cleaning robot 10 moves to the predetermined position of the robot docking station 20, the charging interface of the cleaning robot 10 is just in contact with the charging terminal 211 of the charging stand 21 of the robot docking station 20. At this time, the charging stand 21 is charging the cleaning robot 10. Therefore, the judgment of whether the cleaning robot 10 has moved to the predetermined position of the robot docking station 20 may be performed by judging whether the cleaning robot 10 is in a state of being charged. When it is determined that the cleaning robot 10 is in the state of being charged, it may be determined that the cleaning robot 10 is located at the predetermined position of the robot docking station 20, and hence the cleaning robot 10 is controlled to enter the self-cleaning mode.

The roller brush 141 of the cleaning robot 10 is cleaned in the self-cleaning mode. Generally, when the cleaning robot 10 is in the operating mode for a long time, a considerable amount of dirt adheres to the roller brush 141, and thus a self-cleaning operation is required. However, in some other cases, even when the cleaning robot 10 is in the operating mode for a long time, less dirt adheres to the roller brush 141, depending on the degree of dirtiness of the floor. It will be understood that when less dirt adheres to the roller brush 141, even if the cleaning robot 10 is in the operating mode for a long time, the cleaning robot 10 may not be controlled to enter the self-cleaning mode, in order to achieve effective self-cleaning.

Hence, in some embodiments, S10 may further include:

detecting a degree of dirtiness of the roller brush 141; and judging whether the degree of dirtiness meets a self-cleaning condition;

if yes, controlling the cleaning robot 10 to enter the self-cleaning mode.

Here, the degree of dirtiness may be expressed by using a dirtiness value. The dirtiness value may be determined by the following method, for example.

An image of a target region of the roller brush 141 is acquired by the sensor module 12 arranged on the cleaning robot 10. A total amount of dirt in the target region of the roller brush 141 is determined according to the acquired image of the target region of the roller brush 141. A dirtiness value is expressed by using the total amount of dirt in the target region. It is judged whether the dirtiness value is greater than a dirtiness threshold. When the dirtiness value is greater than the preset dirtiness threshold, it is determined that the degree of dirtiness of the roller brush 141 meets a self-cleaning condition, and hence the cleaning robot 10 is controlled to enter the self-cleaning mode.

For another example, an image of a target region of the roller brush 141 is acquired by the sensor module 12 arranged on the cleaning robot 10. The target region is divided into preset grids. Dirty grids are determined according to the amount of dirt in each of the grids. A dirtiness value is expressed by using a ratio of the number of the dirty grids to the number of all the grids. It is judged whether the dirtiness value is greater than a dirtiness threshold. When the dirtiness value is greater than the dirtiness threshold, it is determined that the degree of dirtiness of the roller brush 141 meets a self-cleaning condition, and hence the cleaning robot is controlled to enter the self-cleaning mode.

After the cleaning robot 10 enters the self-cleaning mode, it is necessary to perform an operation of cleaning the roller brush 141 of the cleaning robot 10 while controlling the operation of the cleaning device 14. Hence, in some embodiments, the step S20 specifically includes:

controlling the liquid supply mechanism to supply a cleaning liquid to the roller brush 141;

controlling rotation of the roller brush 141; and controlling the fan assembly 144 to operate.

During the operation of cleaning the roller brush 141 of the cleaning robot 10, the cleaning robot 10 is located on the tray 22 of the robot docking station 20, and the roller brush 141 of the cleaning robot 10 is just fitted in the cleaning groove 221 of the tray 22 and the roller brush 141 is partially accommodated in the cleaning groove 221. After the self-cleaning mode is activated, it is necessary to clean away dirt adhering to the roller brush 141. Therefore, in this embodiment, the liquid supply mechanism is controlled to supply a cleaning liquid to the roller brush 141 so that the roller brush 141 is soaked. In this process, the roller brush 141 is controlled to rotate and the fan assembly 144 is controlled to operate synchronously. During the rotation of the roller brush 141, the dirt adhering to the roller brush 141 will be brought up. The fan assembly 144 generates a suction force to suck the dirt brought up by the rotation of the roller brush 141. The dirt or cleaning liquid that has not been sucked by the fan assembly 144 falls into the cleaning groove 221. In some embodiments, the cleaning groove 221 may contain a cleaning fluid in order to enhance the effect of washing the roller brush 141. Since the roller brush 141 can be partially accommodated in the cleaning groove 221, the roller brush 141 can be partially immersed in the cleaning fluid. In this case, the liquid supply mechanism may not need to supply the cleaning liquid to the roller brush 141, and it is only necessary to rotate the roller brush 141 or to control an operation of the fan assembly 144 while controlling the rotation of the roller brush 141.

It should be noted that the sequence of implementation of the specific steps of step S20 may be set as actually required. The liquid supply mechanism, the roller brush 141, and the fan assembly 144 may be controlled to operate simultaneously, or two of them may be controlled to operate simultaneously, or the three components may be controlled to operate sequentially in a predetermined order. In this embodiment, the roller brush 141, the liquid supply mechanism, and the fan assembly 144 are controlled to operate sequentially.

Therefore, in the self-cleaning mode, the operation of washing the roller brush 141 can be completed by simply controlling the operation of the cleaning device 14 of the cleaning robot 10, without removing and manually washing the roller brush 141. Accordingly, the entire cleaning task process can be implemented in an efficient, integrated, and comprehensive manner to provide a better user experience.

In some embodiments, the roller brush 141 rotates in the self-cleaning mode at a speed greater than or equal to a speed at which the roller brush 141 rotates in the operating mode. Dirt adhering to the roller brush 141 is easily dislodged from the roller brush 141 by rapidly rotating the roller brush 141, thereby further enhancing the effect of washing the roller brush 141.

In some embodiments, the suction force of the fan assembly 141 in the self-cleaning mode is smaller than or equal to the suction force of the fan assembly 144 in the operating mode. In the self-cleaning mode, dirt adhering to the roller brush 141 will be continuously decreased as compared to the operating mode, thus there is no need to control the fan assembly 144 to generate a large suction force, and the washing requirement can be met with only a small suction force. Therefore, energy loss can be reduced, and noise can also be reduced.

After the roller brush 141 has been washed for a period of time or has been washed clean, the roller brush 141 needs to be further dried. Hence, in some embodiments, the step S20 specifically further includes:

controlling the liquid supply mechanism to stop supplying the cleaning liquid and the roller brush 141 to stop rotating, and controlling the fan assembly 144 to further operate for a preset duration.

After the roller brush 141 has been washed for a period of time, it can be considered that the dirt adhering to the roller brush 141 has been reliably cleaned away. At this time, the liquid supply mechanism is controlled to stop supplying the liquid and the roller brush 141 is controlled to stop rotating. After that, the fan assembly 144 is controlled to continue operating so as to dry the roller brush 141. After the preset duration has elapsed, it can be considered that the roller brush 141 has been reliably dried. At this time, the fan assembly 144 may be controlled to stop operating. The suction force of the fan assembly 141 at this time is smaller than the suction force of the fan assembly 144 in the operating mode, which can meet the drying requirement and help reduce the noise of the fan. Obviously, the preset duration may be set as actually required, and may, for example, be from 5 min to 20 min.

In order to enhance the effect of drying the roller brush 141 within the preset duration, in some embodiments, the step S20 further includes:

controlling the roller brush 141 to rotate for a second time period every first time period within the preset duration, wherein the preset duration is greater than the first time period, and the first time period is greater than the second time period.

For example, it is assumed that the preset duration is set at 5 minutes, the first time period is set at 10 seconds, and the second time period is set at 5 seconds. When the drying of the roller brush 141 is started, the roller brush 141 is controlled to rotate after 10 seconds has elapsed. The roller brush 141 is controlled to stop rotating after the roller brush 141 has rotated for 5 seconds. Then, the roller brush 141 is controlled to rotate after 10 seconds has elapsed. Such process is repeated. The process continues for 5 minutes and then ends.

Therefore, not only a partial region of the roller brush 141, but the entire roller brush 141 can be dried by the fan assembly 144 within the preset duration. Accordingly, the drying effect can be enhanced.

It will be understood that each of the preset duration, the first time period, and the second time period may be determined as actually required and is not limited to that defined in this embodiment. For example, the first time period may also be less than the second time period.

An embodiment of the present disclosure provides a self-cleaning device for a cleaning robot. The cleaning robot includes a cleaning device for cleaning and a driving device for travelling. The cleaning robot is provided with an operating mode and a self-cleaning mode. The self-cleaning device for the cleaning robot includes a control module. The control module is configured to control the cleaning robot to enter the self-cleaning mode, and to control the cleaning device to operate and the driving device to stop operating after entering the self-cleaning mode.

Since the device embodiment and the method embodiment are based on the same concept, a description of the device embodiment may be quoted from the method embodiment so far as they do not conflict with each other. Thus, a detailed description is omitted here.

Figure 6:
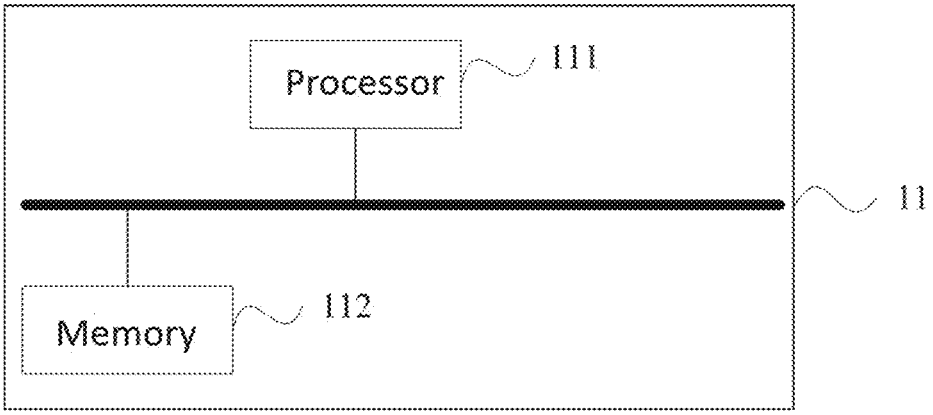
FIG. 6 is a schematic diagram showing a hardware structure of a control module in FIG. 2.
Figure 7:
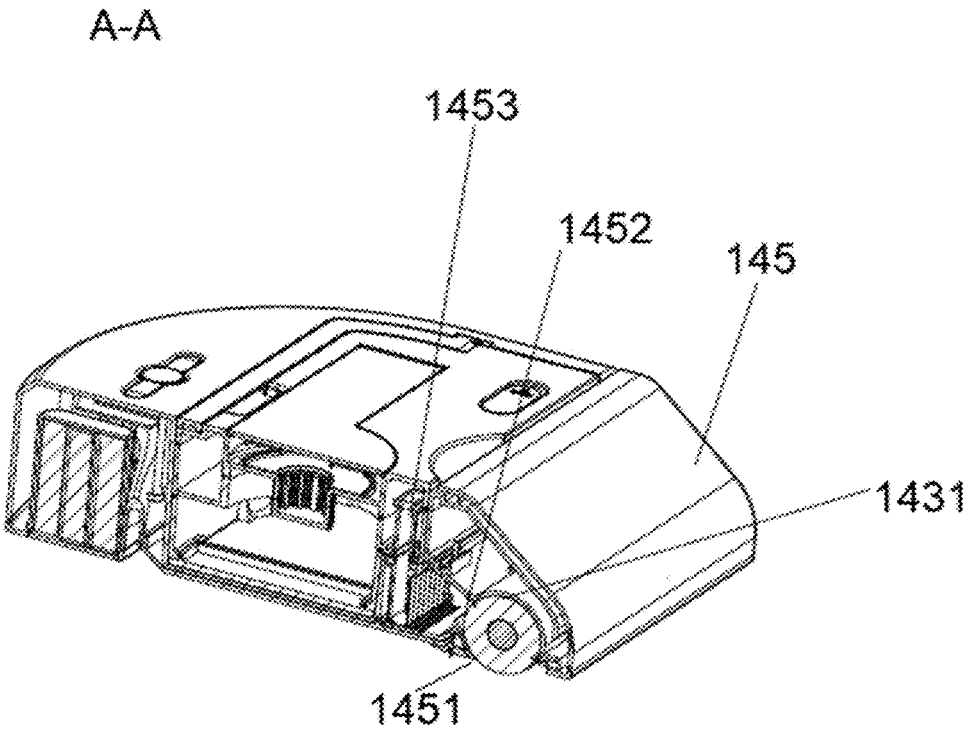
FIG. 7 is a view showing A-A section of the cleaning system in FIG. 1.
Figure 8:
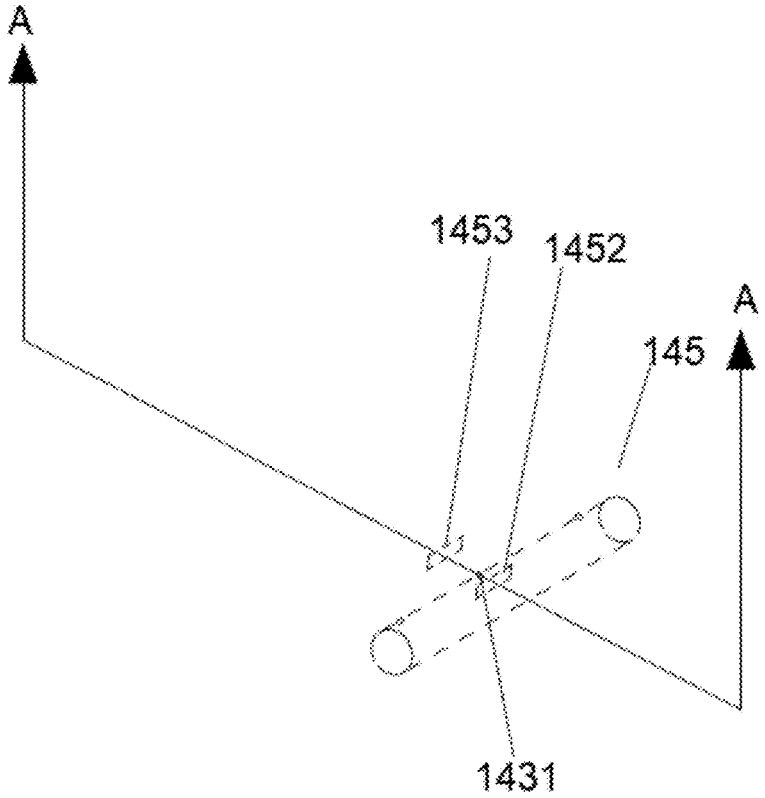
FIG. 8 is a simple schematic diagram showing the dirty water tank, the suction port, the air extraction port and the water outlet structure of the liquid supply mechanism.

FIG. 6 is a schematic diagram showing a hardware structure of a control module in FIG. 1. As shown in FIG. 6, the control module 11 includes one or more processors 111 and a memory 112. Here, one processor 111 is taken as an example in FIG. 6.

The processor 111 and the memory 112 may be connected via a bus or in other ways. The connection via a bus is taken as an example in FIG. 6.

The memory 112, which is a non-volatile computer-readable storage medium, may be configured to store non-volatile software programs, non-volatile computer-executable programs, modules, and so on, such as program instructions corresponding to the method in the foregoing embodiment of the present disclosure and the modules corresponding to the device in the foregoing embodiment of the present disclosure. The processor 111 runs the non-volatile software programs, instructions, and modules stored in the memory 112 to execute various functional applications and data processing in a self-cleaning method for a cleaning robot, namely, to implement a self-cleaning method for a cleaning robot in the foregoing method embodiment and the functions of the respective modules in the foregoing device embodiment.

The memory 112 may include a program storage area and a data storage area. Here, the program storage area may store an operating system and an application program required by at least one function. The data storage area may store data such as those created by use of a self-cleaning device for a cleaning robot.

In addition, the memory 112 may include a high-speed random access memory, or may include a non-volatile memory, such as at least one magnetic disk storage device, flash memory device, or other non-volatile solid-state storage device. In some embodiments, the memory 112 includes memories provided remotely from the processor 111, and these remote memories may be connected to the processor 111 through a network. Examples of the foregoing network include, but are not limited to, the Internet, an intranet, a local area network, a mobile communication network, and a combination thereof.

The program instructions and one or more modules are stored in the memory 112. When they are executed by the one or more processors 111, the respective steps of a self-cleaning method for a cleaning robot in any of the foregoing method embodiments are executed, or the functions of the respective modules of a self-cleaning device for a cleaning robot in any of the foregoing device embodiments are implemented.

The products described above can execute the methods provided in the foregoing embodiments of the present disclosure and have functional modules and advantageous effects corresponding to the executed methods. Technical details those are not described in detail in this embodiment can be understood with reference to the methods provided in the foregoing embodiments of the present disclosure.

An embodiment of the present disclosure further provides a non-volatile computer-readable storage medium. The computer-readable storage medium stores computer-executable instructions. The computer-executable instructions are executed by one or more processors, for example, by one processor 111 in FIG. 6, thereby causing a computer to execute the respective steps of a self-cleaning method for a cleaning robot in any of the foregoing method embodiments, or implement the functions of the respective modules of a self-cleaning device for a cleaning robot in any of the foregoing device embodiments.

An embodiment of the present disclosure further provides a computer program product. The computer program product includes a computer program stored on a non-volatile computer-readable storage medium. The computer program includes program instructions. When the program instructions are executed by one or more processors, for example, by one processor 111 in FIG. 6, a computer may be caused to execute the respective steps of a self-cleaning method for a cleaning robot in any of the foregoing method embodiments, or implement the functions of the respective modules of a self-cleaning device for a cleaning robot in any of the foregoing device embodiments.

It should be noted that the device embodiments described above are merely illustrative, where the units described as separate components may or may not be physically separated, and the components displayed as units may or may not be physical units. In other words, they may be located in one place or distributed over multiple network units. Some or all of the modules may be selected as actually required to achieve the objectives of the solutions of the embodiments.

It will be clearly appreciated, by those of ordinary skill in the art, from the description of the above embodiments that each embodiment may be implemented by means of software plus a general hardware platform, or may, of course, be implemented by hardware. It will be understood by those of ordinary skill in the art that all or some of the processes in the methods of the foregoing embodiments may be implemented by a computer program instructing relevant hardware. The program may be stored in a computer-readable storage medium. The program, when being executed, may include the processes of any of the foregoing method embodiments. Here, the storage medium may be a magnetic disk, an optical disc, a read-only memory (ROM), a random access memory (RAM), or the like.

Finally, it should be noted that present disclosure may be embodied in many different forms and is not limited to the embodiments described herein. These embodiments are not construed as additional limitations of the description of the present disclosure. These embodiments are provided for the purpose of enabling a more thorough and comprehensive understanding of the description disclosed in the present disclosure. Moreover, the foregoing technical features may be combined with each other without departing from the concept of the present disclosure, and there are many other variations in different aspects of the present disclosure as described above, all of which are deemed to fall within the scope of the specification of the present disclosure. Further, modifications or variations can be made by those of ordinary skill in the art based on the above description. All such modifications and variations are intended to fall within the scope of the appended claims of the present disclosure.

What is claimed is:

1. A self-cleaning method for a cleaning robot, wherein the cleaning robot comprises a cleaning device configured for cleaning and a driving device configured for travelling, and the cleaning robot comprises an operating mode and a self-cleaning mode, wherein the self-cleaning method comprises:

controlling the cleaning robot to enter the self-cleaning mode; and controlling the cleaning device to operate and the driving device to stop operating after entering the self-cleaning mode, wherein the cleaning device comprises a roller brush, a liquid supply mechanism, a fan assembly and a dirty water tank, wherein the liquid supply mechanism is configured to supply a cleaning liquid to the roller brush, the roller brush is configured to rotate to scrub a floor, the fan assembly is configured to generate a suction force to suck dirt, and the dirty water tank has an accommodating groove configured for allowing at least part of the roller brush to be accommodated therein, a suction port corresponding to the roller brush and communicating with the accommodating groove, and an air extraction port in communication with the fan assembly, wherein the step of controlling the cleaning device to operate comprises:

controlling the liquid supply mechanism to supply the cleaning liquid to the roller brush;

controlling the roller brush to rotate; and controlling the fan assembly to operate, to extract gas, so that the gas inside the dirty water tank is extracted through the air extraction port and discharged to form a negative pressure in the suction port and then dirt brought up by rotation of the roller brush is sucked into the suction port during the rotation of the roller brush.

2. The self-cleaning method according to claim 1, wherein the step of controlling the cleaning device to operate further comprises:

controlling the liquid supply mechanism to stop supplying the cleaning liquid and the roller brush to stop rotating, and controlling the fan assembly to further operate for a preset duration.

3. The self-cleaning method according to claim 2, wherein the step of controlling the cleaning device to operate further comprises:

controlling, within the preset duration, the roller brush to rotate for a second time period every first time period, wherein the preset duration is greater than the first time period, and the first time period is greater than the second time period.

4. The self-cleaning method according to claim 1, wherein the roller brush rotates in the self-cleaning mode at a speed greater than or equal to a speed at which the roller brush rotates in the operating mode.

5. The self-cleaning method according to claim 1, wherein a suction force of the fan assembly in the self-cleaning mode is smaller than or equal to a suction force of the fan assembly in the operating mode.

6. The self-cleaning method according to claim 1, wherein the cleaning robot further comprises an input module, the step of controlling the cleaning robot to enter the self-cleaning mode comprises:

receiving a self-cleaning instruction by the input module;

controlling the cleaning robot to enter the self-cleaning mode according to the self-cleaning instruction.

7. The self-cleaning method according to claim 1, wherein the step of controlling the cleaning robot to enter the self-cleaning mode comprises:

judging whether the cleaning robot is in a state of being charged, and if yes, controlling the cleaning robot to enter the self-cleaning mode.

8. The self-cleaning method according to claim 1, wherein the step of controlling the cleaning robot to enter the self-cleaning mode comprises:

judging whether the cleaning robot has moved to a predetermined position of a robot docking station, and if yes, controlling the cleaning robot to enter the self-cleaning mode.

9. The self-cleaning method according to claim 1, wherein the step of controlling the cleaning robot to enter the self-cleaning mode comprises:

detecting a degree of dirtiness of the roller brush; and judging whether the degree of dirtiness meets a self-cleaning condition, and if yes, controlling the cleaning robot to enter the self-cleaning mode.

10. The self-cleaning method according to claim 1, wherein the step of controlling the cleaning robot to enter the self-cleaning mode comprises:

acquiring an operating duration for which the cleaning robot is operated in the operating mode; and judging whether the operating duration reaches a preset duration threshold, and if yes, controlling the cleaning robot to enter the self-cleaning mode.

11. A cleaning robot, comprising a cleaning device configured for cleaning, a driving device configured for travelling, and a control module, wherein the control module is electrically connected to the cleaning device and the driving device, respectively, wherein the cleaning device comprises a roller brush, a liquid supply mechanism, a fan assembly and a dirty water tank, wherein the liquid supply mechanism is configured to supply a cleaning liquid to the roller brush, the roller brush is configured to rotate to scrub a floor, the fan assembly is configured to generate a suction force to suck dirt, and the dirty water tank has an accommodating groove configured for allowing at least part of the roller brush to be accommodated therein, a suction port corresponding to the roller brush and communicating with the accommodating groove, and an air extraction port in communication with the fan assembly, wherein the control module is configured to execute the self-cleaning method according to claim 1.

12. The cleaning robot according to claim 11, wherein the step of controlling the cleaning device to operate further comprises:

controlling the liquid supply mechanism to stop supplying the cleaning liquid and the roller brush to stop rotating, and controlling the fan assembly to further operate for a preset duration.

13. The cleaning robot according to claim 11, wherein the step of controlling the cleaning device to operate further comprises:

controlling, within the preset duration, the roller brush to rotate for a second time period every first time period, wherein the preset duration is greater than the first time period, and the first time period is greater than the second time period.

14. The cleaning robot according to claim 11, wherein the cleaning robot further comprises an input module, the step of controlling the cleaning robot to enter the self-cleaning mode comprises: receiving a self-cleaning instruction by the input module;

controlling the cleaning robot to enter the self-cleaning mode according to the self-cleaning instruction.

15. The cleaning robot according to claim 11, wherein the step of controlling the cleaning robot to enter the self-cleaning mode comprises:

judging whether the cleaning robot has moved to a predetermined position of a robot docking station, and if yes, controlling the cleaning robot to enter the self-cleaning mode.

16. A cleaning system, comprising a cleaning robot and a robot docking station, wherein the robot docking station comprises a charging stand and a tray connected to the charging stand, the tray is configured to carry the cleaning robot, the charging stand is configured to supply charging power to the cleaning robot, and the cleaning robot is the cleaning robot according to claim 11.

17. The cleaning system according to claim 16, wherein the tray defines a cleaning groove, wherein the cleaning groove is configured to accommodate at least part of the roller brush of the cleaning robot.

18. The cleaning system according to claim 17, wherein the tray comprises a plurality of raised features arranged on a bottom of the cleaning groove.

* * * * *